US005796414A

United States Patent [19]

Sievert et al.

[11] Patent Number: 5,796,414

[45] Date of Patent: Aug. 18, 1998

[54] SYSTEMS AND METHOD FOR ESTABLISHING POSITIONAL ACCURACY IN TWO DIMENSIONS BASED ON A SENSOR SCAN IN ONE DIMENSION

[75] Inventors: Otto K. Sievert, Encinitas; Gregory D. Nelson, Escondido, both of Calif.

[73] Assignee: Hewlett-Packard Company, Palo Alto, Calif.

[21] Appl. No.: 625,422

[22] Filed: Mar. 25, 1996

[51] Int. Cl.[6] ..... B41J 29/393

[52] U.S. Cl. ..... 347/19; 347/37

[58] Field of Search ..... 347/19, 37, 12, 347/14, 38, 39, 107; 356/399–401; 235/401; 256/462, 237 G

[56] References Cited

U.S. PATENT DOCUMENTS

| | | | |
|---|---|---|---|
| 4,856,903 | 8/1989 | Kipphan et al. | 356/400 |
| 4,878,753 | 11/1989 | Nestmeier | 356/237 |
| 5,287,162 | 2/1994 | de Jong et al. | 399/49 |

FOREIGN PATENT DOCUMENTS

| | | | |
|---|---|---|---|
| 0 444 583 | 9/1991 | European Pat. Off. | B41F 33/00 |
| 0 575 162 | 12/1993 | European Pat. Off. | G03G 15/01 |
| 2 113 388 | 8/1983 | United Kingdom | G01B 11/27 |

*Primary Examiner*—Peter S. Wong
*Assistant Examiner*—Gregory J. Toatley, Jr.

[57] ABSTRACT

The invention is a system for determining positional deviation of at least one automatic marking implement from a nominal position, and an apparatus and method for establishing positional accuracy of such an implement. Calibration patterns including diagonal indicia are formed along only one dimension of a printing medium by the implement, or implements. Preferably a sensor automatically scans the diagonal pattern along one dimension, ideally the same dimension—without operating in a second, orthogonal direction. Nevertheless scanning of the diagonal indicia enables development of composite information about deviations in both directions. There is no necessity of either forming or sensing any pattern that is extended (by more than one marking-implement swath) in two different directions. The composite information is combined with information about deviations along the same scanning direction exclusively, to extract in isolated form the deviation information for the second, orthogonal direction. The invention is particularly useful in determining deviations from nominal offsets between plural marking implements, such as thermal-inkjet pens holding ink of different colors in a computer-controlled printer.

10 Claims, 12 Drawing Sheets

SYSTEMS AND METHOD FOR ESTABLISHING POSITIONAL ACCURACY IN TWO DIMENSIONS BASED ON A SENSOR SCAN IN ONE DIMENSION

RELATED PATENT DOCUMENT

Closely related documents are other, coowned U.S. utility-patent applications filed in the United States Patent and Trademark Office before this document—and hereby incorporated by reference in its entirety into this document. Those documents set forth in considerable detail the background of the field of art, problems in the field, and prior efforts to resolve those problems.

Those related documents are in the names of Cobbs et al., and stem from an original patent application entitled "MULTIPLE INKJET PRINT CARTRIDGE ALIGNMENT BY SCANNING A REFERENCE PATTERN AND SAMPLING SAME WITH REFERENCE TO A POSITION ENCODER" and filed as U.S. utility-patent application 08/055,624 filed Apr. 30, 1995—now abandoned, but succeeded by file-wrapper continuing application 08/540,908filed Oct. 11, 1995, which issued as U.S. Pat. No. 5,600,350 on Feb. 4, 1997, and divisional application 08/585,051, filed Jan. 11, 1996.

BACKGROUND

1. Field of the Invention

This invention relates generally to machines and procedures for printing text or graphics on printing media such as paper, transparency stock, or other glossy media; and more particularly to systems and a method for determining positional deviations of one or more automatic marking implements used in such printing. The invention is useful particularly but not exclusively in scanning thermal-inkjet printers that construct text or images from individual ink spots created on a printing medium, in a two-dimensional pixel array.

2. Related Art

A representative modern computer-controlled desktop printer or drafting-room plotter employs an automatic marking implement such as an inkjet pen or dot-matrix printing head. Ordinarily the implement is mounted on a carriage, which most typically scans across a printing medium in a first of two orthogonal directions.

Periodically, relative motion of the medium with respect to the carriage in a second of the two directions, too, is also provided—most commonly by moving the medium, but equivalently by shifting a carriage gantry. This second component of relative motion enables the marking implement to eventually have access to every part of the desired image area of the printing medium.

To achieve color effects and also even for certain types of high-throughput monochrome printing, it is now common to employ plural or multiple marking implements together in a single such printer or plotter. In some such special cases, plural banks of implements may have different alignments—but most often the implements are mounted adjacent to one another on a common carriage, which carries the implements together across the medium in the first orthogonal direction. Here too, relative motion of the medium in the second direction is provided so that each implement gains access to, typically, the entire image area.

A modern printing system operates using extremely fine positional control—to achieve a pixel-grid spacing of, nowadays, some 0.08 mm or 0.04 mm (0.003 or 0.0015 inch). It has been found economic, however, to control the absolute position of an individual marking implement (e. g., a single inkjet printhead or pen) only to about ±0.25 mm (±0.01 inch)—which is an overall span of about 0.5 mm (0.02 inch), or about six to twelve times the pixel-grid spacing.

In typical monochrome printing with a single head this tolerance of ±0.25 mm is normally inconsequential, since it manifests itself only as uncertainty in positioning of the overall image on the sheet of printing medium, and margins are usually much greater than a quarter millimeter. Within the image, the head position is maintained constant to considerably finer tolerance than the pixel-grid spacing.

Therefore the features of the image are quite adequately in register with one another. That is, precision is usually sufficient even though accuracy is much coarser than the pixel-grid spacing.

On the other hand, even within an image or a series of images, interhead precision may sometimes be inadequate for a period of time after a printer is first turned on, as positioning varies with (among other factors) temperature. Thus there are certain exceptions to the sufficiency of relative positioning. Some such exceptions may come into play even in a single-head printing regimen.

Misregistration becomes a more significant problem, however, in a multiple-printhead system—since different elements of an image are physically formed by different heads or marking implements.

More specifically, such different "elements" most commonly are markings on the print medium in different primary colors (e. g., the subtractive colorants cyan, magenta and yellow, plus black). In such a system, misregistration between pens can for example create thin bands of incorrect color, or no color at all where color should be, along the edges of objects portrayed in an image.

As mentioned above, overall uncertainties on the order of six to twelve times the pixel spacing can be important even in systems using a single automatic marking implement. Systematic error of such magnitude is plainly unacceptable in the multicolor environment, or more generally in any modern system using plural automatic marking implements. Paper slippage and paper skew, as well as mechanical misalignments of the marking implements, contribute to inaccuracies along both the media-advance axis and the carriage-scan axis.

(For desktop printers it has become generally conventional to identify the carriage-scan direction as the x axis and the media-advance direction as the y axis. For large-format plotters, however, the convention observed is precisely the opposite—i. e., the media-advance direction is the x axis and the carriage-scan direction the v axis. These respective conventions have been observed in the drawings of the present document.)

For these reasons it is important to determine and control the deviation in position of each marking implement from its nominal position—and the deviation in relative positions of plural marking implements (that is, the distances between or among the implements) from their nominal values. In short, we wish to establish the positional accuracy of the one or more implements.

The previously mentioned patent documents of Cobbs et al. (whose preferred embodiments were developed mainly for large-format printer applications) propose to resolve the positional-accuracy problem by calibrating the positions of plural marking implements relative to one another. Those documents describe operation of the plural implements to lay down calibration test patterns of bars in two orthogonal directions, as shown in FIGS. 9, 10*a* and 10*b* of the present document:

one pattern 406 extending along the transverse dimension of a sheet of printing medium, parallel to the scanning direction of the marking implements, with the individual bars within the pattern running perpendicular to that transverse direction (i. e., "vertical" bars, in the usual orientation of a sheet of printing medium); and a second pattern 408' along the longitudinal dimension of such a sheet, parallel to the medium-advance direction, with the individual bars within the pattern running perpendicular to that longitudinal direction (i. e., "horizontal" bars).

Within each pattern of bars, in an exemplary four-printhead printer, a first group of roughly a quarter of the bars is made by one printhead, a second group by another printhead, and so on—allowing each head to record ample information for determination of the relative phase of its bar pattern to the other heads' bar patterns.

A sensor mounted on the marking-implement carriage then traverses the calibration test patterns, and an associated electronic system determines any inconsistencies between resulting signal wavetrains produced by the different implements respectively. The system interprets these inconsistencies in terms of positional deviations from the nominal interhead spacing.

The Cobbs documents show how signals from the sensor can be filtered, amplified, sampled, digitized, fitted to an ideal sine wave, and then digitally phase-analyzed to determine net positional deviations from nominal. These net deviations are then used to shift the image elements formed by some of the heads to match those formed by others.

In the horizontal direction, the shift is achieved by introducing a small delay or advance in phase, for energization of each printhead respectively—to create each pixel column. In the vertical direction, the shift is achieved by selecting for actual use a group of marking subimplements within each implement (e. g. nozzles, in an inkjet printhead) which is less than the total number of subimplements in the implement.

In the inkjet environment, the group that is used may for instance be as high as nozzles #1 through #96, in a pen that has one hundred four nozzles total—or as low as nozzles #9 through #104. Other systems for vertically shifting the actually printed swath of each printhead will be apparent to those skilled in the art, for this and other environments.

In order to accomplish all this, the system of Cobbs et al. must lay down its pattern of vertical indicia (more specifically vertical straight lines), by scanning transversely. This pattern is for reading by the sensor later in the transverse-positioning calibration.

In addition the system must lay down a pattern of horizontal indicia (more specifically horizontal straight lines), by transverse scanning interspersed with longitudinal relative movement of the printing medium. This pattern is for reading by the sensor later in the longitudinal-positioning calibration.

Overall, the efforts of Cobbs et al. greatly ameliorate a difficult problem in the art, both for desktop printers and large-format plotters, and it is by no means our intention to minimize their efforts. This latter portion of the technology, however, is not entirely ideal—for three reasons, listed below.

The first two arise in common from the fact that control of motion of the printing medium is not as accurate as control of motion of the carriage which transports the printheads:

(1) printing of the medium-advance-direction calibration pattern requires at least several swaths of markings, introducing undesirable variations within the printed test pattern itself—due to printing-medium advance and the multiple carriage sweeps that are required;

(2) reading the medium-advance-direction calibration pattern likewise requires vertical relative movement of the medium relative to the sensor, once again introducing undesired variations in resulting data; and (3) for simplest implementation the medium must be free to move in both the positive and negative directions, along the longitudinal dimension (the printing-medium advance dimension)—or the medium must be removed entirely from the printer and fed back in again, potentially introducing major divergences in alignment, which influence the effective grid spacing as read by the sensor.

Thus there remains room for useful and important refinement, in establishing the positional accuracy of automatic marking implements along the direction orthogonal to the scan or sweep direction—particularly relative accuracy, as between plural such implements.

SUMMARY OF THE DISCLOSURE

The present invention introduces such refinement. In its preferred embodiments, the present invention has several aspects or facets that can be used independently, although they are preferably employed together to optimize their benefits.

Before setting forth those independent aspects in a formal or relatively rigorous way, we wish to provide an informal introduction to some of the concepts of our invention. It is to be understood that this introduction is not a definition of the invention, although recognition of these concepts may form a part of the inventive process that has led to our invention.

We have recognized that marking-implementation separation in both the longitudinal and transverse dimensions can be determined through forming a calibration pattern during operation in only one of those two directions—and likewise passing a sensor over that pattern in only one of the two directions. In purest principle the direction of pattern formation need not be the same as that of pattern sensing. Preferably, however, the transverse dimension is chosen for both the writing and reading operations, since—as mentioned above—positional control is considerably better along that direction.

In order to obtain information about both longitudinal and transverse positions through writing and reading of a test pattern in one direction only, a test pattern can be used that includes indicia which are substantially diagonal—relative to, for instance, the longitudinal dimension considered as "vertical". The instant at which a sensor then reaches any one of the indicia depends upon the mechanical deviations of the marking implement from nominal position both vertically and horizontally.

The actual mechanical deviation along only the horizontal direction is easily found separately by operation of a system with "vertical" bars as in the Cobbs system. The overall apparent horizontal displacement found by scanning the diagonal bars can then be analyzed to find the portion of that overall horizontal displacement which is due to mechanical vertical deviation, simply by subtracting away the purely horizontal component.

Unless the diagonals are at forty-five degrees, it is also desirable to apply to the remainder a correction for the actual orientation of the calibration-pattern bars, to find the actual vertical deviation.

More specifically, a formula for this analysis can be found geometrically. If the total observed horizontal displacement is $\delta_T$—and the portion of this overall apparent horizontal displacement $\delta_T$ which arises from mechanical horizontal deviation in the writing process is identified as $\delta_H$—then the portion $\delta_V'$ of that same overall horizontal displacement $\delta_T$ which arises from vertical deviation exclusively is:

$$\delta_{V'}=\delta_T-\delta_H$$

and the mechanical vertical deviation itself is $\delta_V$, $\cot\theta$ or:

$$\delta_V=(\delta_T-\delta_H)\cot\theta.$$

If the bars are oriented at forty-five degrees, $\cot\theta=1$ and no arithmetic correction is needed.

It will be understood that this analysis applies equally to (1) individual marking-implement positional deviation from a nominal absolute position and (2) deviations of relative spacing, between one marking implement and another, from a nominal relative spacing.

Now we turn to a more-formal description of our invention. In preferred embodiments of a first of its facets or aspects, the invention is a system for determining positional deviation of at least one automatic marking implement from a nominal position.

The system includes a printing medium. The system also includes a positional-deviation calibration pattern. The calibration pattern comprises an array of substantially diagonal indicia, formed on the printing medium by the at least one automatic marking implement.

The foregoing may constitute a description or definition of the first facet of the invention in its broadest or most general form. Even as to this form, however, it can be seen that this aspect of the invention significantly mitigates the difficulties left unresolved in the art.

In particular, as explained in the informal introduction the diagonal indicia of the calibration pattern on the print medium enable development of composite information about horizontal and vertical deviations. Such information can be adduced with no necessity of either forming or sensing any pattern that is extended (by more than one printhead swath) in two different directions.

Although this aspect of the invention in its broad form thus represents a significant advance in the art, it is preferably practiced in conjunction with certain other features or characteristics that further enhance enjoyment of overall benefits.

For example, it is preferred that the system further include a transversely scanning automatic sensor. This sensor is for reading the substantially diagonal indicia to obtain information about the positional deviation.

Several other preferences and advantages will be clear from the "DETAILED DESCRIPTION" section that follows. These particularly include use of plural subarrays, a multiplicity of substantially parallel lines, uniform width and spacing, angles of twenty to seventy (preferably thirty to sixty) degrees, formation all in a single scan, and use in conjunction with an adjacent array of substantially vertical indicia.

In a second of its independent aspects or facets, the invention is a method for establishing positional accuracy of at least one automatic marking implement—relative to a nominal position. The method is for use with a printing medium which has first and second mutually orthogonal directions.

The method includes the step of determining positional deviations with respect to a first of the directions. The method also includes another step of operating the at least one implement along that same first direction to form a test pattern on the medium.

In addition the method includes the step of scanning a sensor along, still, the first direction to read the test pattern, substantially without advancing the printing medium in the second direction. Further the method includes the step of then finding positional deviations along the second direction—by combining (1) the determined deviations with respect to the first direction with (2) the sensor readings of the test pattern.

The foregoing may constitute a description or definition of the second facet of the invention in its broadest or most general form. Even in this general form, however, it can be seen that this aspect of the invention, too, significantly mitigates the difficulties left unresolved in the art.

In particular, the method of this second aspect of the invention permits establishment of positional accuracy relatively quickly and efficiently—and without either requiring bidirectional printing-medium transport (or refeeding of a sheet of medium for a second pass through the printer) or depending on the relatively unreliable longitudinal movement of the printing medium.

Although this second aspect of the invention in its broad form thus represents a significant advance in the art, it is preferably practiced in conjunction with certain other features or characteristics that further enhance enjoyment of overall benefits.

For example, it is preferred that the method further include the step of then applying the found positional deviations, along the first and second directions, to control operation of the automatic marking implement.

It is also preferable that the method include the step of recording, in a memory device, instructions for the foregoing steps. In this case it is further preferable that the method include the step of automatically retrieving those instructions from the memory device, and effectuating them to effect performance of those foregoing steps.

In a third basic aspect or facet, the invention is an apparatus that establishes positional accuracy of at least one automatically positioned marking device, relative to a nominal position. The marking device of this apparatus is for relative motion along first and second mutually orthogonal directions.

This apparatus of the invention includes means for determining positional deviations with respect to a first of the two directions. The apparatus also includes a test pattern defined along that first direction.

Further included is a sensor mounted with the marking device. In addition the apparatus includes some means for scanning the sensor with the marking device together along the first direction to read the test pattern—substantially without relative motion of the sensor or device along the second direction.

The apparatus additionally includes some means for then finding positional deviations along the second direction by combining (1) the determined deviations with respect to the first direction with (2) the sensor readings of the test pattern.

Once again, preferred embodiments of this third main aspect or facet of the invention represent an important advance relative to the prior and related art, as may be seen from the relationship of this aspect of the invention to the second, method aspect discussed earlier. In a sense, however, the benefits of this aspect of the invention sweep somewhat more broadly as it is not necessarily limited to apparatus which itself actually forms the test pattern.

Yet this apparatus aspect of the invention too is preferably practiced with certain further characteristics or features that optimize the enjoyment of its benefits. For example this aspect of the invention preferably further includes some means for applying the found positional deviations along the first and second directions to control operation of the automatically positioned marking device.

In addition the invention apparatus preferably includes a memory device holding recorded instructions for the foregoing steps. In this case the apparatus also preferably includes some means for automatically retrieving and effectuating those instructions from the memory device to effect performance of those foregoing steps.

All of the foregoing operational principles and advantages of the present invention will be more fully appreciated upon consideration of the following detailed description, with reference to the appended drawings, of which:

DETAILED DESCRIPTION OF THE PREFERRED EMBODIMENTS

Figure 1:
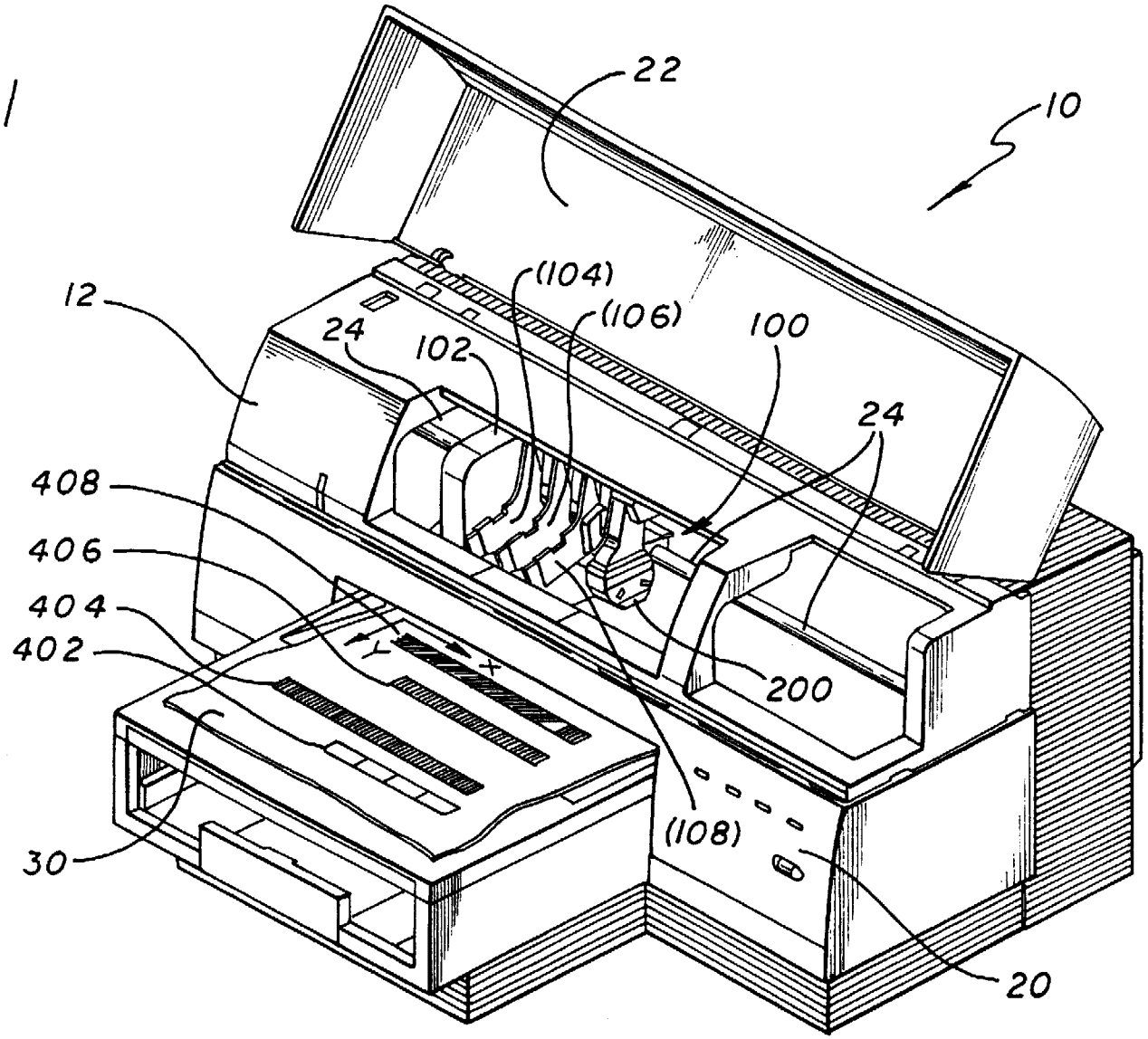
FIG. 1 is a perspective view of a thermal inkjet desktop printer incorporating or constituting (not to scale) a preferred embodiment of the present invention.
Figure 1A:
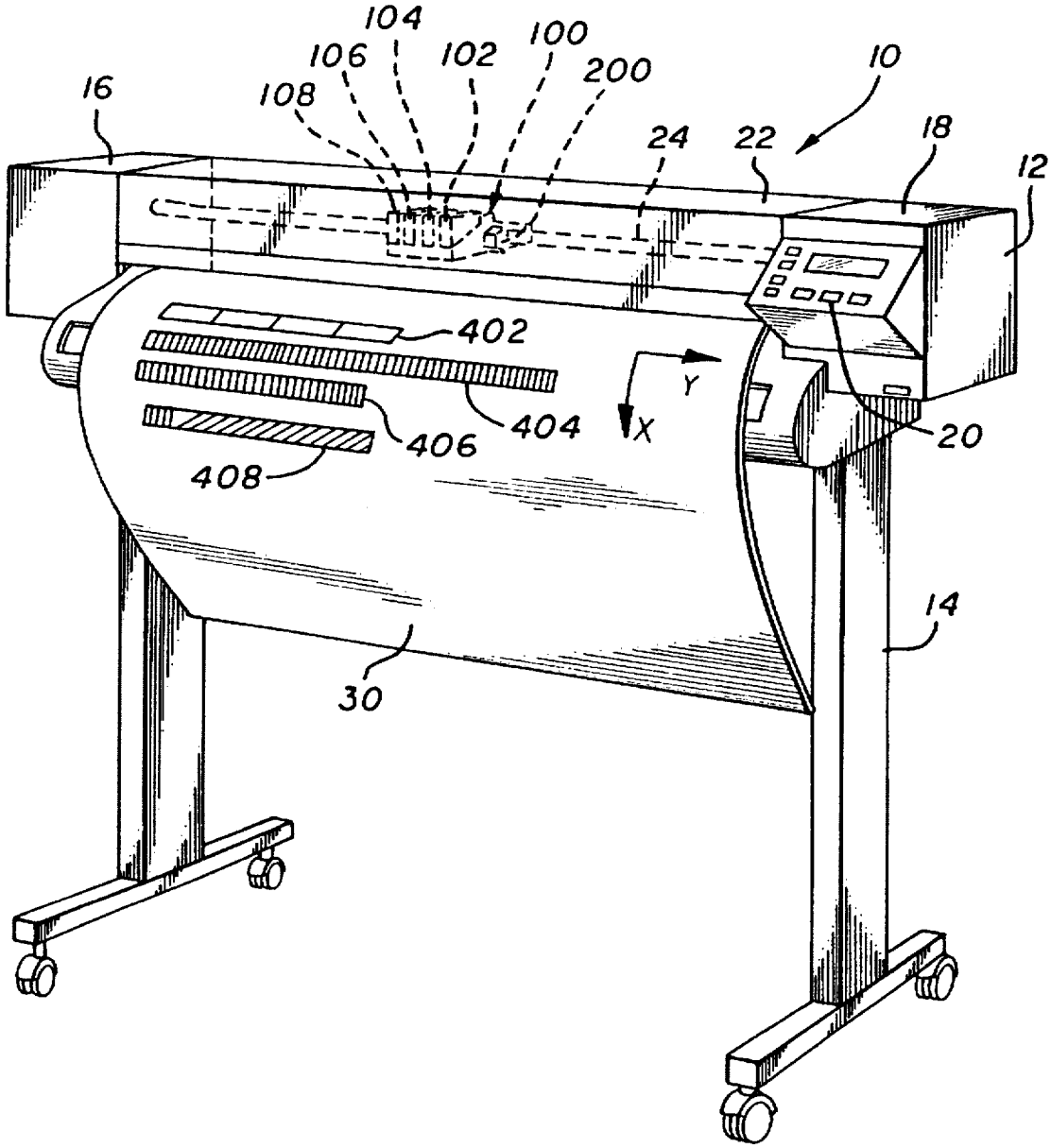
FIG. 1*a* is a like view of a large-format printer/plotter likewise incorporating or constituting the FIG. 1 embodiment of the present invention—corresponding components having like reference numerals, respectively.

As FIGS. 1 and 1*a* indicate, preferred embodiments of the invention are advantageously incorporated into an automatic printer, as for instance a thermal-inkjet desktop printer or large-format plotter respectively. The printer or plotter 10 includes a housing 12, with a control panel 20.

As to the plotter of FIG. 1*a*, the working parts may be mounted on a stand 14; and the housing 12 has left and right drive-mechanism enclosures 16 and 18. The control panel 20 is mounted on the right enclosure 18.

A carriage assembly 100 (which for the large-format plotter of FIG. 1*a* is illustrated in phantom under a transparent cover 22), is adapted for reciprocal motion along a slider rod or carriage bar 24 (also in phantom for the plotter). The position of the carriage assembly 100 in a horizontal or carriage-scan axis is determined by a carriage positioning mechanism (not shown) with respect to an encoder strip (not shown), as is very well known in the art.

Preferably the carriage 100 includes four stalls or bays for automatic marking implements such as inkjet pens that print with ink of different colors. These are for example black ink and three chromatic-primary (e. g. yellow, magenta and cyan) inks, respectively.

FIG. 1 shows, for the desktop printer, a single representative pen 102—and the remaining three empty bays marked with reference numbers in parentheses thus: (104), (106) and (108). For the large-format plotter, FIG. 1*a* shows all four pens 102, 104, 106, and 108.

In both the printer and the plotter, as the carriage assembly 100 translates relative to the medium 30 along the x and v axes, selected nozzles in all four thermal-inkjet cartridge pens are activated. In this way ink is applied to the medium 30.

The colors from the three chromatic-color inkjet pens are typically used in subtractive combinations by over-printing to obtain secondary colors; and in additive combinations by adjacent printing to obtain other colors.

Figure 2:
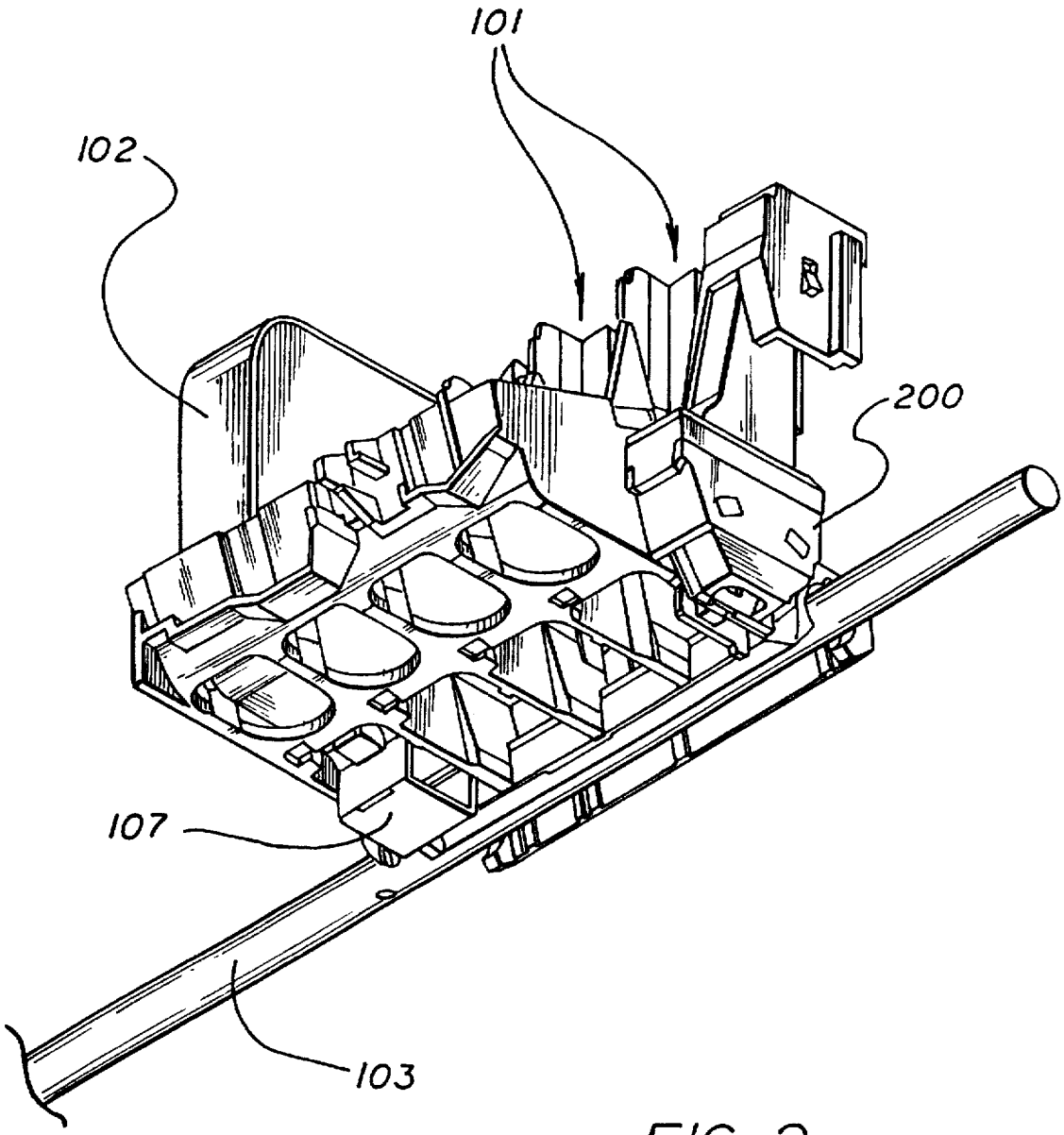
FIG. 2 is a perspective view, taken from below and to the right, of the carriage assembly of the FIG. 1 (desktop printer) embodiment, showing the sensor module generally.
Figure 2A:
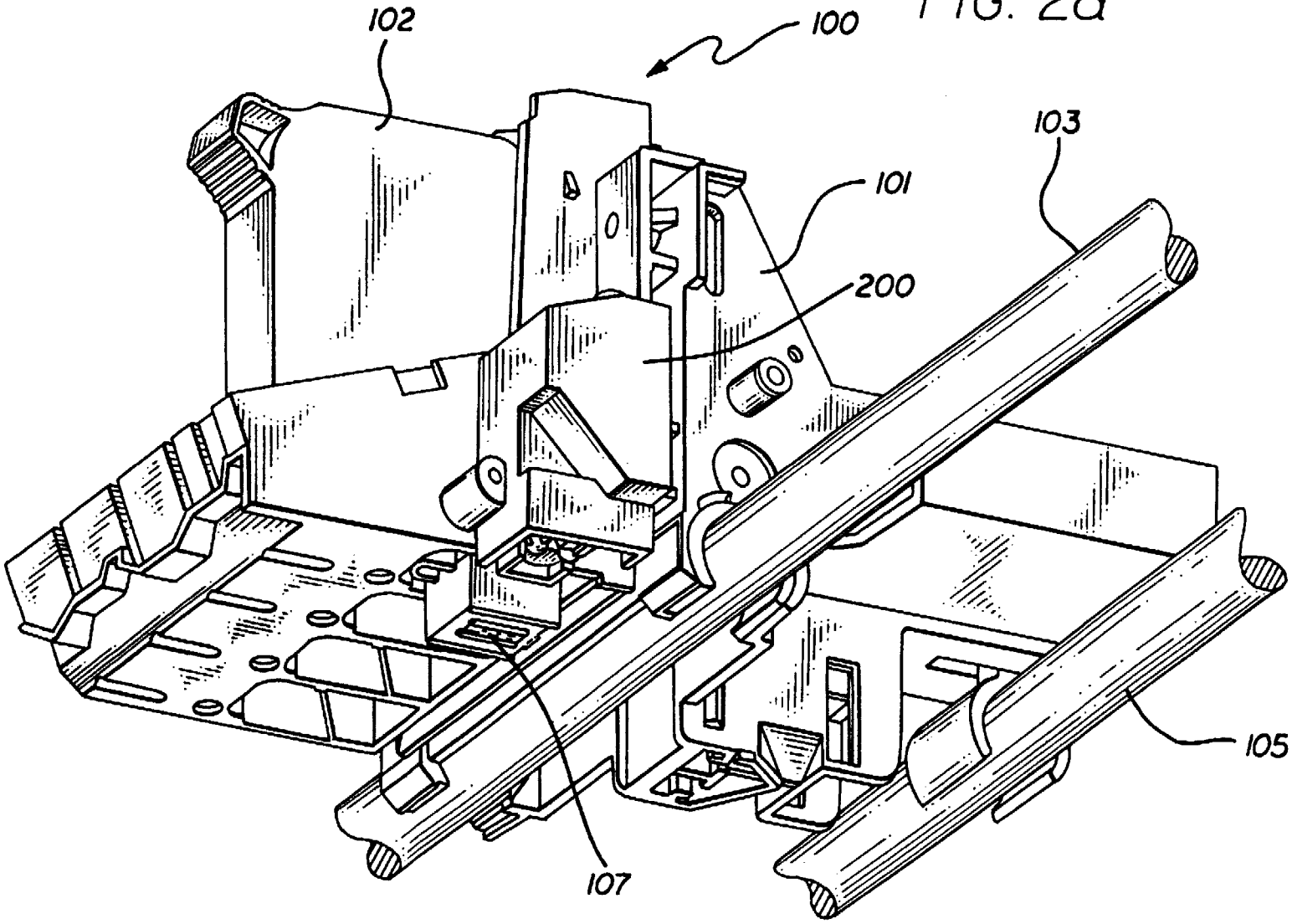
FIG. 2*a* is a like view of the corresponding carriage assembly of the FIG. 1*a* (large-format plotter) embodiment.

The carriage assembly 100 includes a carriage 101 (FIG. 2) adapted for reciprocal motion on a slider bar or carriage rod 103. For the much greater transverse span in the large-format plotter (FIG. 2*a*), there are a front slider rod or carriage bar 103 and a like rear rod/bar 105. A representative first pen cartridge 102 is shown mounted in a first stall of the carriage 101.

Considerable additional information about a carriage drive and control system that is suitable for integration with the present invention appears in the Cobbs et al. documents. That drive and control system is substantially conventional and will not be further treated here.

A printing medium 30 such as paper is positioned along a vertical or printing-medium-advance axis by a medium-advance drive mechanism (not shown). As is common in the art and as mentioned earlier, for desktop printers the carriage-scan axis is denoted the x axis and the medium-advance axis is denoted the v axis; and for large-format plotters conversely.

Printing-medium and carriage position information is provided to a processor on a circuit board that is preferably disposed on the carriage assembly 100. The carriage assembly 100 also may hold the circuitry required for interface to firing circuits (including firing resistors) in the inkjet pens.

Also mounted to the carriage assembly 100 is a sensor module 200. Note that the inkjet nozzles 107 (FIG. 2) of the representative pen 102, and indeed of each pen, are in line with the sensor module 200.

As explained earlier, full-color printing and plotting require that the colors from the individual pens be precisely applied to the printing medium. This requires precise alignment of the carriage assembly. Unfortunately, paper slippage, paper skew, and mechanical misalignment of the pens in conventional inkjet printer/plotters result in offsets along both the medium- or paper-advance axis and the scan or carriage axis.

Preferably a group of test patterns 402, 404, 406, 408 is generated (by activation of selected nozzles in selected pens while the carriage scans across the medium) whenever any of the cartridges is disturbed—for instance just after a marking implement (e. g., pen) has been replaced. The test patterns are then read by scanning the electrooptical sensor 200 over them, and analyzing the resulting waveforms.

The sensor module 200 optically senses the test pattern and provides electrical signals, to the processor on the carriage, indicative of the registration of the portions of the pattern produced by the different marking implements respectively.

Figure 4A:
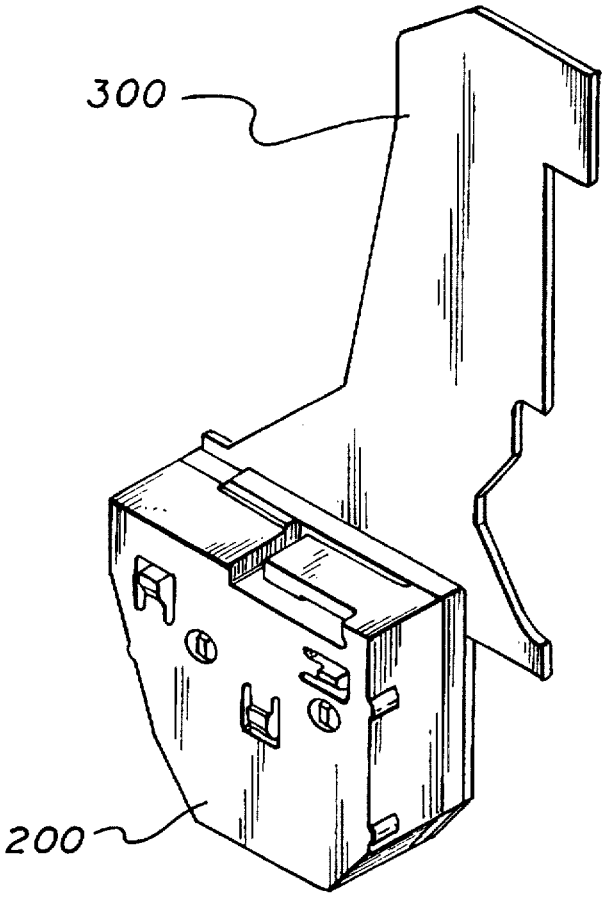
FIG. 4*a* is an exterior perspective view of the sensor module and associated printed-circuit board used in the preferred embodiment of FIGS. 1 and 2.
Figure 4B:
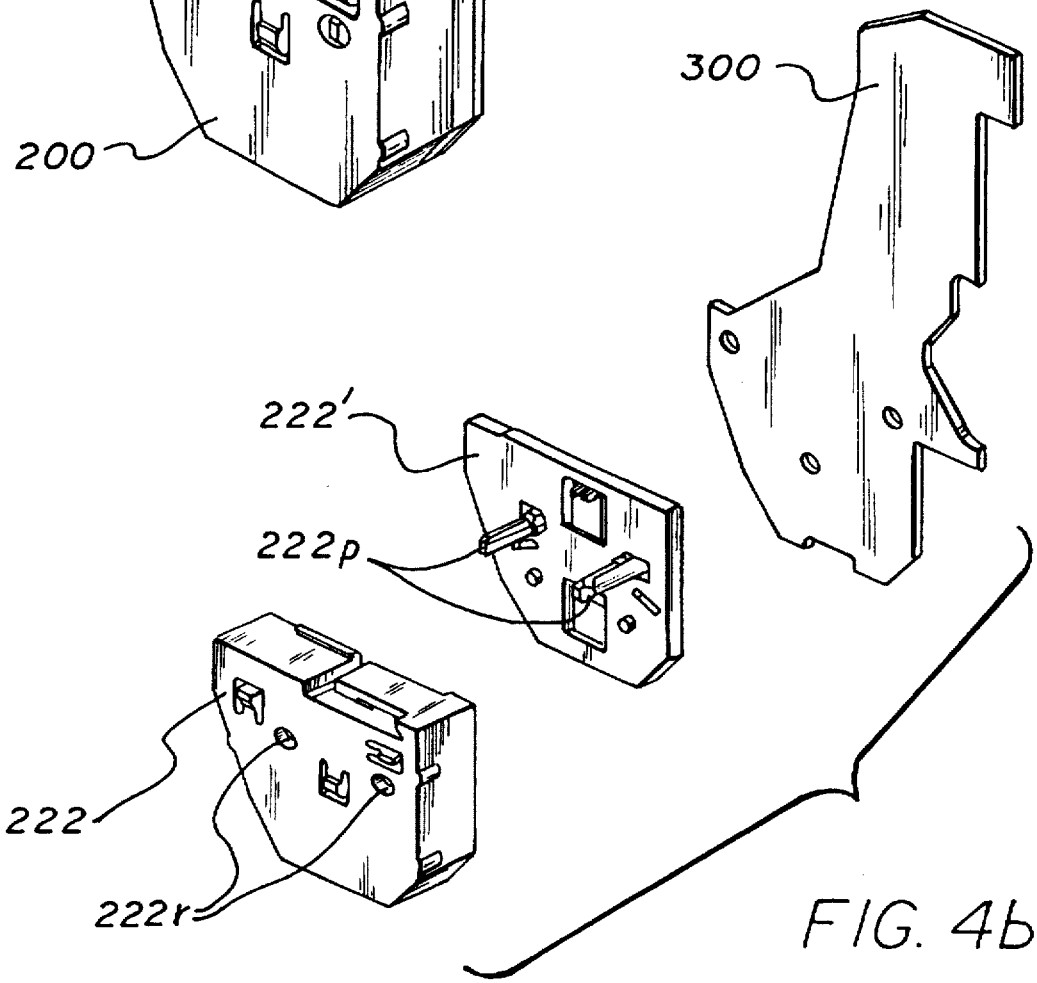
FIG. 4*b* is an exploded perspective view of the two half-cases of the FIG. 4*a* sensor module and printed-circuit board.
Figure 4C:
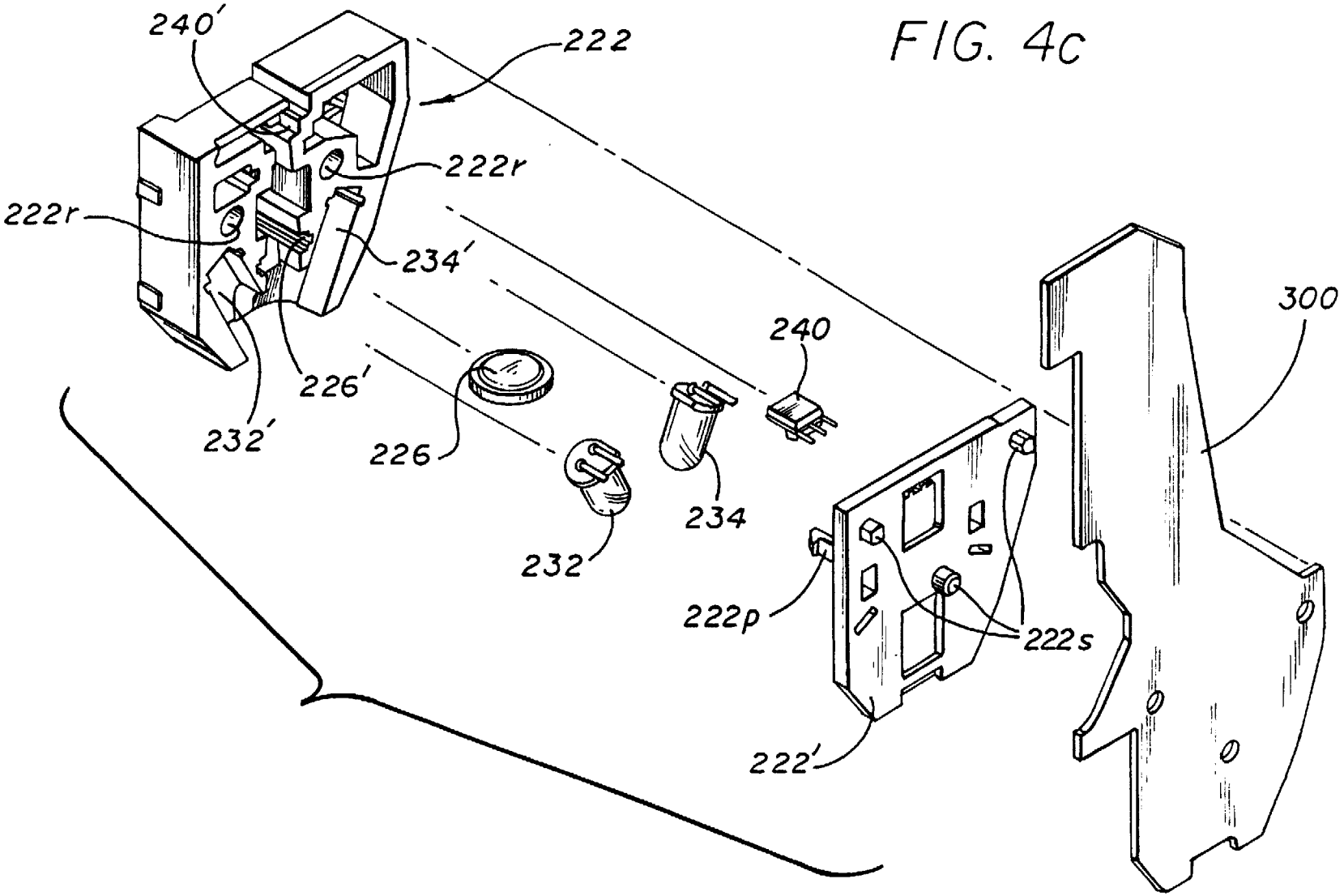
FIG. 4*c* is an exploded perspective view of the same elements shown in FIG. 4*b* but taken from the opposite side and also including the interior components.
Figure 4D:
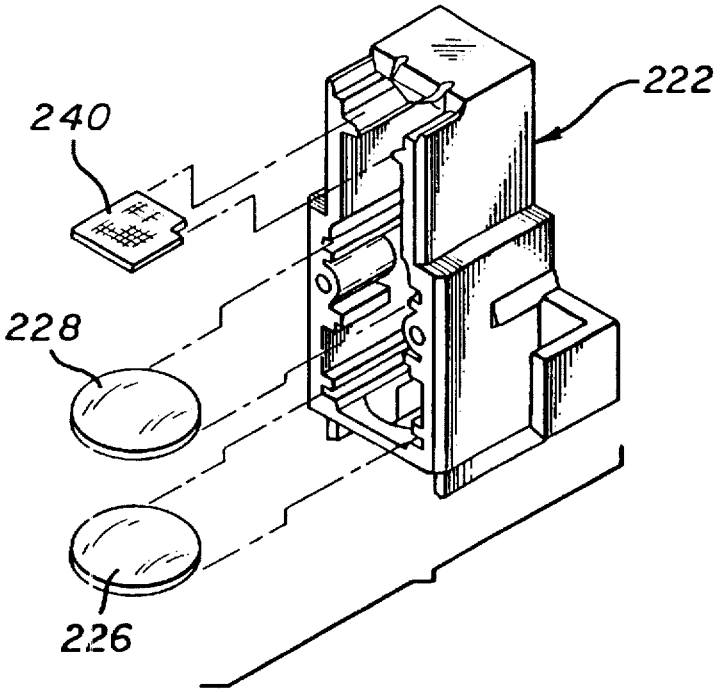
FIG. 4*d* is an interior perspective view of a principal inner subassembly of a sensor that may be used in the preferred embodiment of FIGS. 1*a* and 2*a;*
Figure 5:
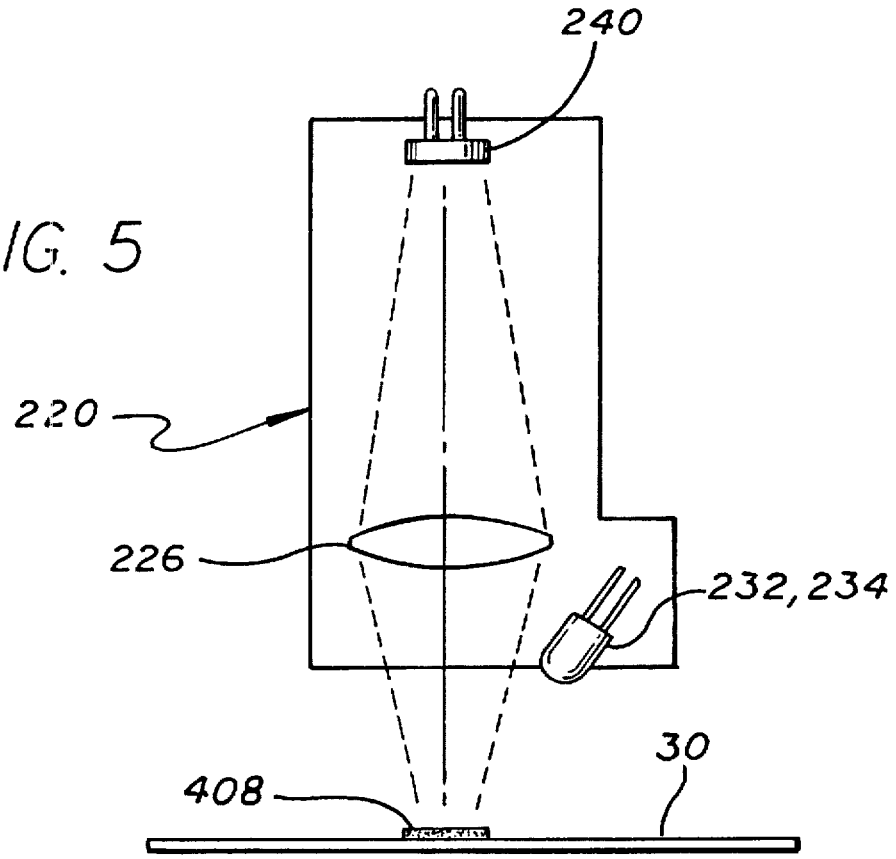
FIG. 5 is a very highly schematic diagram of the optical elements in the sensor module of the preferred desktop-printer embodiment of FIGS. 1, 2, and 4*a* through 4*c;*

FIGS. 4*a* through 4*d* show representative sensor modules 200 utilized in the two preferred embodiments of the lower-numbered drawings. Each sensor module 200 includes an optical component holder 222, with a lens 226 (or if preferred a more-complicated focal system with a second lens 228, FIG. 4*d*, such as that shown by Cobbs et al.) fixed relative to a detector 240 (FIG. 5).

Whereas the system of Cobbs et al. is said to benefit from use of a phase plate over the detector, we have found that in our desktop-printer system entirely adequate performance is obtained with no such plate—relying only on the optical apertures intrinsically established by the focal system and detector. Nonetheless a phase plate may be advantageous for preferred embodiments in a larger-format plotter. In the absence of such a plate, approximately sinusoidal response during scanning is perhaps enhanced by interaction between the test-pattern bars and the generally circular cross-section of the detector.

First and second light emitting diodes (LEDs) 232 and 234 are mounted to the sensor module 200, at an angle as shown, along with an amplifier and other circuit elements (not shown). The light-emitting diodes and photodetector are of conventional design and have a bandwidth which encompasses the frequencies of the colors of the marking implements 102, 104, 106, 108.

For best results, however, special measures are employed to obtain fully adequate data with respect to a yellow-ink marking implement. Commonly available detectors are relatively unable to distinguish the corresponding yellow light from the white background of a typical printing medium 30.

While this ambiguity may be resolved by use of an optical filter, we prefer to avoid this added cost by printing a percentage-tone background using magenta ink, and then immediately overprinting the yellow test-pattern bars. The yellow ink interacts with the still-damp magenta ink, causing a spreading and wicking phenomenon that converts the percentage magenta tone to solid magenta inking in the regions where the yellow "bars" are printed—resulting, in short, in solid magenta bars, which the sensor readily detects.

The optical elements 240, 226, 232, 234 are conveniently supported in a simple molded-plastic component holder 222. The holder 222 has an upper ledge 240' for the detector 240, opposed intermediate slots 226' for the lens 232, and angled lower-lateral cavities 232', 234' for the LEDs 232, 234.

A retaining plate 222' has fastening pegs 222*p* which snap into mating receptacles 222*r* of the holder 222, to keep the optical elements in place. Standoffs 222*s* at an opposite face of the retaining plate 222' provide proper spacing of the retainer 222' from the associated printed-circuit board 300.

In operation, light from the LEDs 232 and 234 impinges upon the test patterns 408 etc. on the printing medium 30 and is in part reflected to the photodetector 240 via the focal system 226—which focuses the energy onto the photodetector 240. As the sensor module 200 scans the test pattern 406 or 408 along the carriage-scan axis only, an output signal is provided which varies approximately as a sine wave.

Associated circuitry (FIG. 8) stores these signals and examines their phase relationships to determine the alignments of the pens for each direction of movement. Preferably the system corrects for carriage-axis misalignment—and print-medium-axis misalignment—and can be used to correct for offsets due to speed and curvature as well. All these options are discussed at length in the Cobbs et al. documents and so need not be repeated here.

Figure 3:
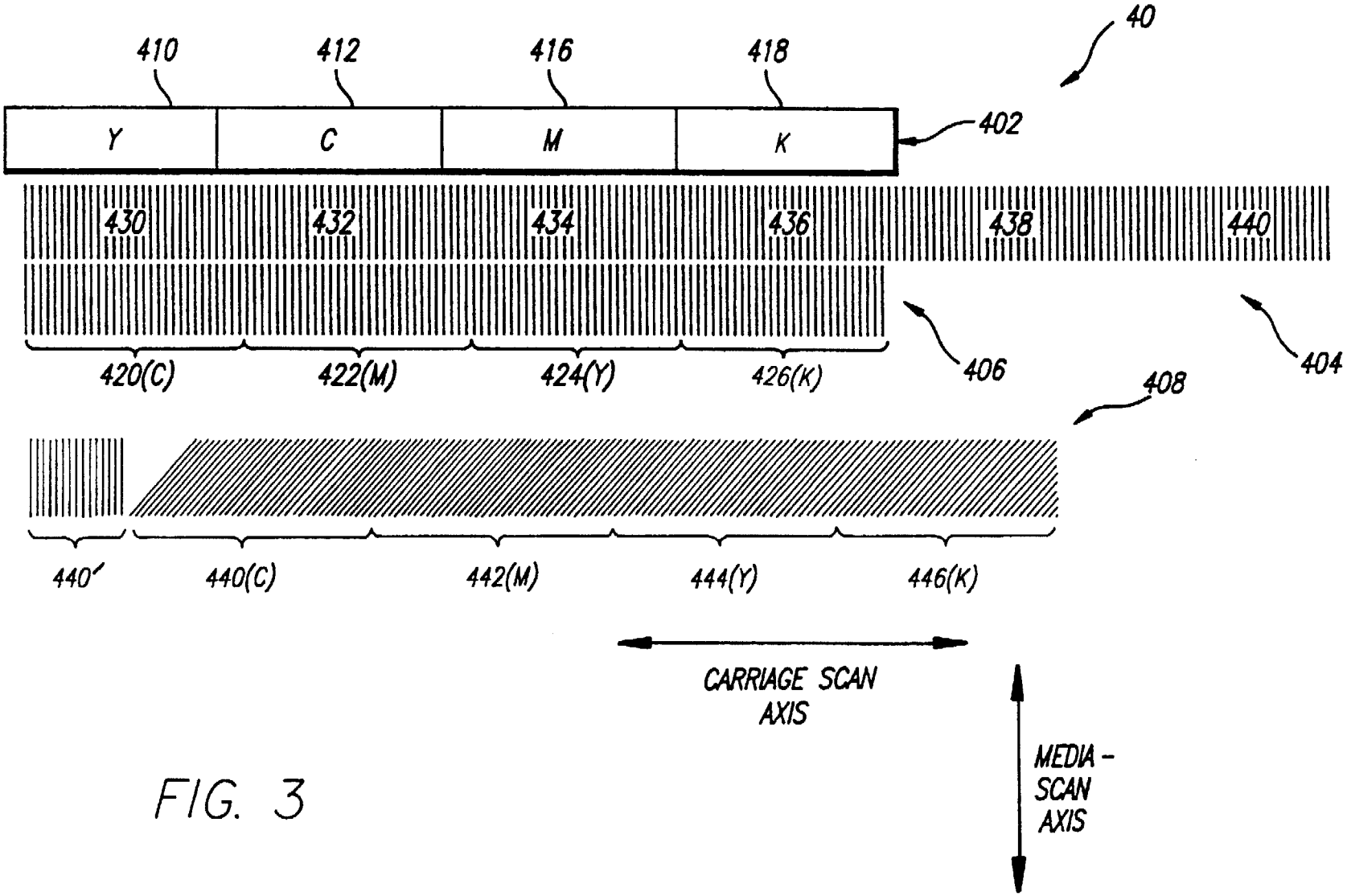
FIG. 3 is a magnified view (not to scale) of the test patterns utilized to effect pen alignment in accordance with the same two embodiments.
Figure 6A:
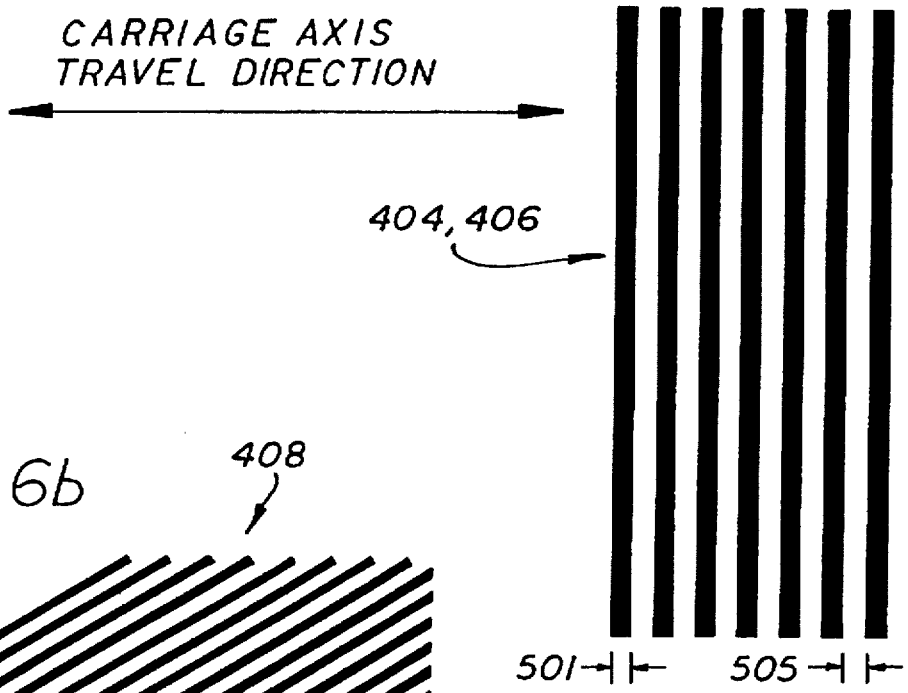
FIG. 6*a* is illustrative of the pure carriage-axis-deviation test-pattern portion (not to scale) of the FIG. 3 test patterns, and is shown even further magnified than in FIG. 3.
Figure 6B:
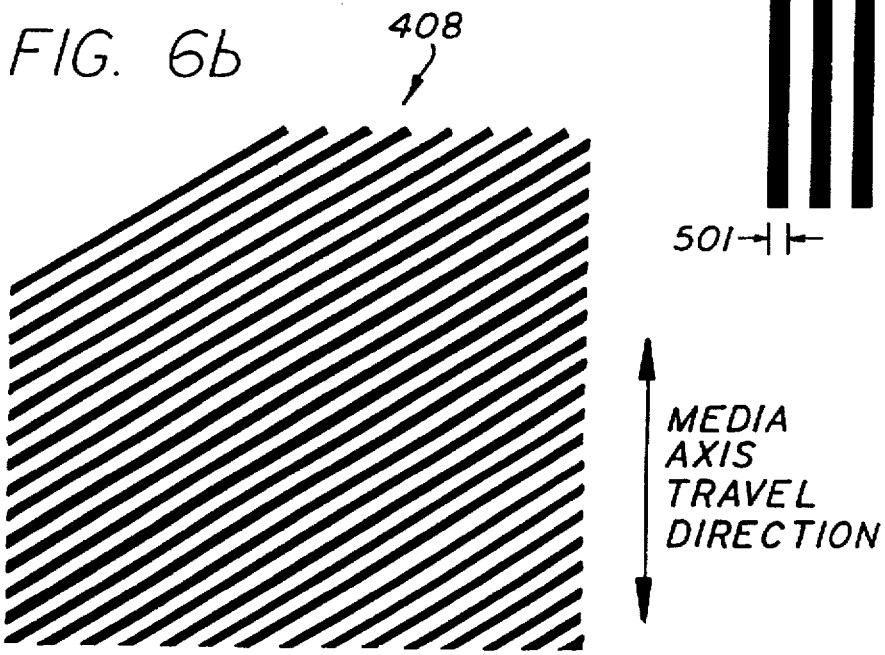
FIG. 6*b* is a like view of the "composite information" test-pattern portion of the FIG. 3 embodiment.

A first step is generation of the test patterns of FIG. 1—shown progressively enlarged in FIGS. 3 and 6. The first pattern 402 is generated in the scan axis merely for the purpose of exercising the marking implements preparatory to actual measurements.

The first pattern 402 includes one segment for each cartridge utilized. For example, the first segment 410 is yellow (Y), the second segment 412 is cyan (C), the third segment 416 is magenta (M) and the fourth segment 418 is black (K).

Next, the second, third and fourth patterns 404, 406 and 408, respectively, are generated. The second pattern 404 may be used to test for pen offsets due to speed and curvature as described by Cobbs et al.

The third pattern 406 is used to test for misalignments in the carriage-scan axis, also per Cobbs. The fourth pattern 408 is used to test for misalignments along the medium-advance axis. In each of patterns 404 through 408, yellow is preferably printed in compound fashion, over a magenta tone as previously described.

Correction for deviations in the carriage-scan axis

The carriage-scan-axis alignment pattern 406 is generated by causing each pen to print a plurality of horizontally spaced vertical bars. The thickness 501 of each bar is equal to the spacing 505 between bars. In the third pattern 406 the first segment 420(C) is cyan; the second segment 422(M), magenta; the third segment 424(Y) yellow and the fourth segment 426(K) black.

Figure 7:
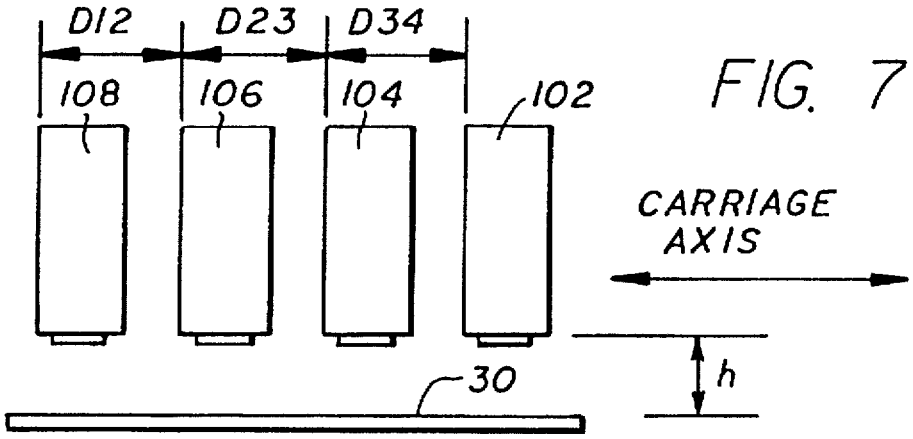
FIG. 7 is a very schematic rear elevation of first, second, third and fourth inkjet cartridges or other marking implements, positioned over a printing medium for movement along the carriage-scan axis.

Pen offsets in the carriage-scan axis are illustrated in FIG. 7. The inkjet cartridges 102, 104, 106 and 108 are positioned a height h over the printing medium 30 for movement along the carriage-scan axis.

The nominal distances D12, D23, and D34 between the cartridges—or compensation for any deviations from those nominal distances—are essential to proper registration of the ink drops from each cartridge with respect those of the other cartridges.

Pen misalignments in the carriage-scan axis are determined by scanning the sensor 200 over the third pattern 406, along the carriage-scan axis. As the sensor module 200 illuminates the third pattern 406, the focal system 226 (and 228 if present) focuses an image on the detector 240.

In effect the pattern of illuminated bars is superimposed on the detector, in the detector plane—or conversely. In response, the photodetector 240 generates a roughly sinusoidal output signal which is the mathematical convolution of the generally round system apertures with the test pattern 406.

Figure 8:
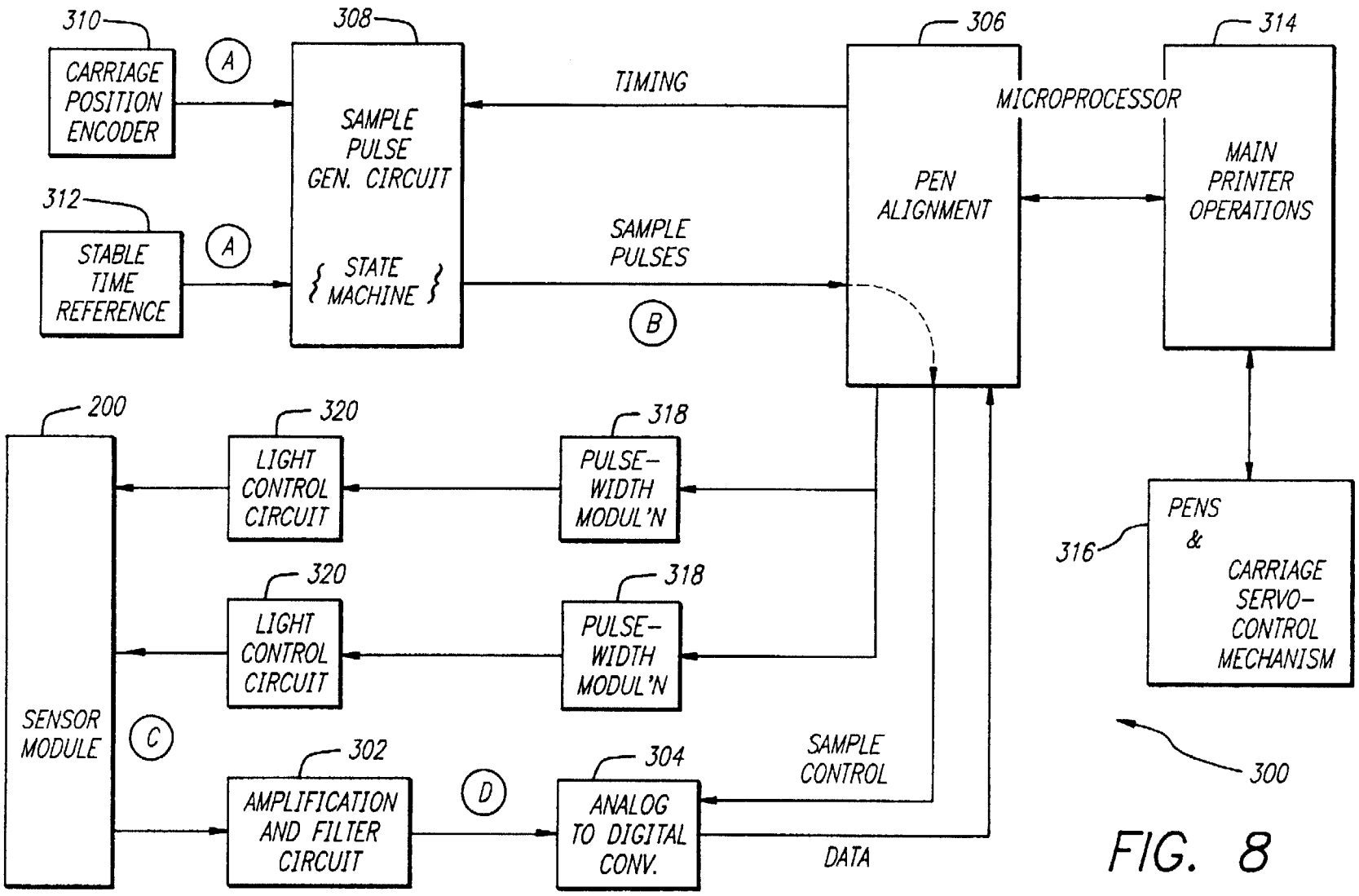
FIG. 8 is a block diagram of the electronic circuit utilized in the preferred embodiments.
Figure 9:
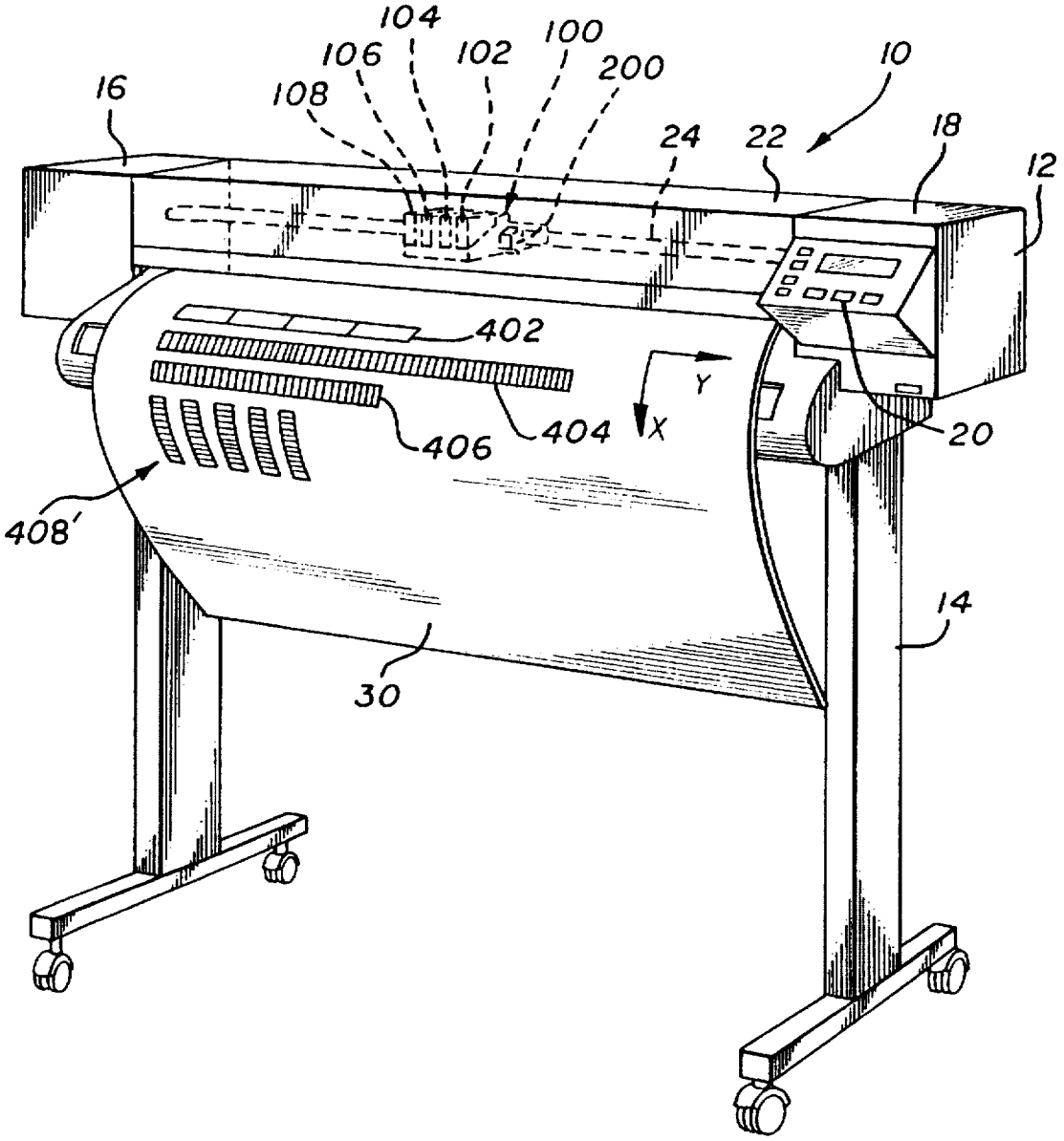
FIG. 9 RELATED ART
FIG. 9 is a view similar to FIG. 1, but with the related-art media-advance calibration pattern discussed in the earlier "BACKGROUND" section of this document.
Figure 10A:
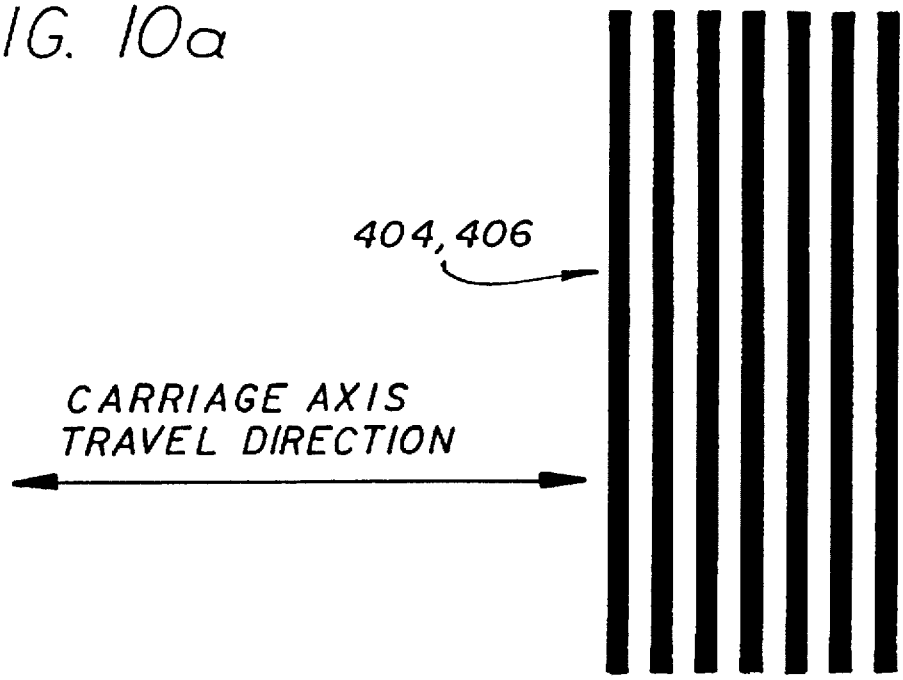
FIG. 10*a* is a view substantially identical to FIG. 6*a*, but repeated for convenient reference with FIG. 10*b*.
Figure 10B:
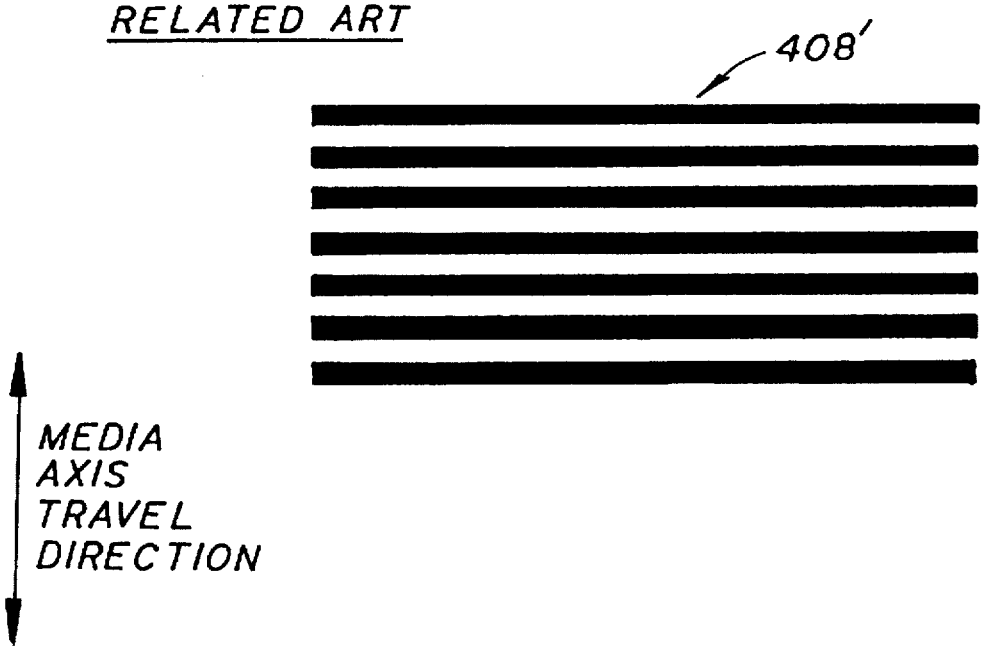
FIG. 10b RELATED ART
FIG. 10*b* is a view similar to FIG. 6*b*, but showing the related-art media-advance calibration pattern.

FIG. 8 is a block diagram of the electronic circuit 300 utilized in the alignment system of the present invention. The circuit 300 includes an amplification and filtering circuit 302, an analog-to-digital converter 304, a pen-alignment operations block 306 (typically in a unitary programmed microprocessor), a sample-pulse generator circuit 308, a carriage-position encoder 310, a stable time base 312, a main printer-operations function block 314 (in the same microprocessor mentioned above), marking pens and a carriage-axis servocontrol mechanism 316, paired pulse-width modulators 318, and respective light-control circuits 320 for the LEDs 232, 234 (FIGS. 4*c* and 5).

Electrical signals from the sensor module 200 are amplified, filtered (yielding a more accurate sinusoid, with less harmonic content, environmental disturbance etc.), and sampled by the alignment-operations block 306. The carriage position encoder 310 provides pulses as the carriage assembly 100 moves along the encoder strip (not shown).

The sample pulse generator circuit 308 selects pulses from the carriage position encoder 310 or the stable time reference 312, depending on the test being performed. The data can be analyzed with Discrete Fourier Transform methods to find the separations and deviations. Alternatively the electronics find a phase difference between a reference sine wave (synchronized with carriage position) and the sensed sine wave—as set forth by Cobbs et al. in extensive detail.

In either event, the system uses three parameters of the phase difference: its location, to indicate which cartridge is out of alignment; its polarity, to indicate the direction of misalignment; and its magnitude to indicate the magnitude of the misalignment.

The corresponding data, describing offsets for each cartridge, are stored. These data are used to control activation of the pens as the assembly is scanned in the carriage axis via the servomechanisms 316. Sensor-module light activation is provided by the alignment-operations block 306, pulse-width modulators 318 and light-control circuits 320.

Correction of offsets due to speed and curvature may be developed as in Cobbs, if desired.

Correction of offsets in the printing-medium-advance axis and between pens

Another source of image misregistration derives from printing-medium slippage or skew on the roller or platen. In accordance with the present teachings, there is no need to print or sense a print-medium-advance-axis test pattern that is extended (by more than one print swath) along the medium-advance direction. Instead a test pattern 408 with diagonal bars is printed along the carriage-scan direction—the whole set being printed without advancing the printing medium at all.

The entire test pattern 408 (FIGS. 3 and 6*b*) actually includes, within the same swath as the diagonal lines, an initial short segment 440' of vertical black bars to establish extremely accurate phase coordination with the carriage-position encoder system. The diagonal bars follow, in four segments 440(C), 442(M), 444(Y) and 446(K) laid down by the four marking implements respectively.

As previously explained, this pattern is scanned by the sensor and the resulting offset data developed, either through Discrete Fourier Transform methods or through fitting a standard sine curve to the sampled data as in Cobbs et al. We prefer to operate the sensor several times over the diagonal bars to maximize the signal-to-noise ratio for the phase data from the several runs.

Offset data so derived include effects of both horizontal and vertical mechanical deviations. Therefore they must be adjusted for the independently determined horizontal mechanical deviations—and if necessary for the angle of the diagonal bars—to find the vertical mechanical deviations. If the angle is quite close to forty-five degrees, then as mentioned earlier the implicit correction is a factor of one and no actual arithmetic is needed.

We prefer to orient the bars of the test pattern at forty-five degrees—not so much to avoid the necessity of multiplying by a nonunity value of $\cot\theta$ as to distribute possible errors somewhat equally in the two orthogonal directions of the system. Results that are almost as good, however, can be obtained with the bar orientation at any value in a range that is roughly centered about forty-five degrees.

Based on our observations and calculations we consider the critical range for reasonably good performance to be thirty to sixty degrees. These critical values may be conceptualized as follows. If the bars are more steeply angled to the vertical than about sixty degrees, the accuracy of detecting the positions of the bars begins to degrade severely; and if they are less steeply angled to the vertical than about thirty degrees, the accuracy of reflecting the positional determination into the vertical dimension—which is to say, the determination of interest—begins to likewise degrade severely.

A second critical range, for performance that is marginal rather than reasonably good, we consider to be twenty to seventy degrees. For these more-extreme limits the conceptualization is analogous to that set forth just above, but here accuracies degrade so severely that acquisition of meaningful calibration results may not be practical—for example, may require an inordinately large number of sensor passes or prohibitively long times.

It is not strictly necessary that all the bars be at the same angle, or uniform in spacing or thickness, or even straight. In principle these parameters are all variable because the microprocessor which prints the pattern with such variations can be taught to recall the specifics of variation at pattern-sensing time and subtract them out, or cancel them out, of the resulting signals. As a practical matter, however, straight bars of uniform angle, spacing and thickness are preferable to simplify the data processing and minimize the calibration time.

The pure-horizontal deviations may be measured or interpreted either before or after printing and scanning of the diagonal bars, since the answers are independent of sequence. It is only necessary that the horizontal mechanical deviation data be available for the final step of arithmetic adjustment.

Scanning and sensing of the diagonal bars can be performed in either direction; however, when scanning the sensor from right to left the algebraic sign of the calculated vertical deviation is reversed. For example, if a particular marking implement is higher than it should be, with the diagonal bars oriented as in FIGS. 3 and 6*b*, the sensor will reach each bar early when scanning from left to right (corresponding to the formula for $\delta_V$ given earlier)—but late when scanning from right to left.

To use the yellow-over-magenta printing system mentioned earlier, it is helpful to record the yellow and magenta inks in very close time sequence. This can be accomplished most effectively during scanning from right to left, if the pens are physically disposed in the sequence of FIG. 3.

Offsets between pens, along the medium-advance axis, can be corrected by selecting certain nozzles for activation, as described by Cobbs et al., or by masking the data as between swaths of the marking implements. The Cobbs technique has the drawback of requiring extra nozzles; whereas the data-masking technique has the drawback of introducing undesirable variations in colorant-laydown sequence in some regions of the printout, and also somewhat increasing computation complexity and time.

The foregoing detailed disclosure is intended as merely exemplary, and not to limit the scope of the invention—which scope is to be determined by reference to the appended claims.

What is claimed is:

1. A system, for use with a plurality of automatic marking implements that scan transversely, and for determining positional deviations, as between the implements, from a nominal position; said system comprising:

a printing medium; and a positional-deviation calibration pattern comprising an array of substantially diagonal indicia formed on the printing medium by the automatic marking implements;

said array comprising a plurality of subarrays each formed by one of such plurality of implements respectively, each subarray being an assemblage of substantially diagonal indicia; and each subarray comprising a multiplicity of substantially parallel lines;

wherein the indicia are all formed in a single scan.

2. A system, for use with a plurality of automatic marking implements that scan transversely, and for determining positional deviations, as between the implements, from a nominal position; said system comprising:

a printing medium; and a positional-deviation calibration pattern comprising an array of substantially diagonal indicia formed on the printing medium by the automatic marking implements;

said array comprising a plurality of subarrays each formed by one of such plurality of implements respectively, each subarray being an assemblage of substantially diagonal indicia; and wherein the subarrays are disposed in series transversely across the printing medium.

3. A system for determining positional deviation of at least one automatic marking implement from a nominal position, and for use with such an automatic marking implement that scans transversely; said system comprising:

a printing medium; and a positional-deviation calibration pattern comprising an array of substantially diagonal indicia formed on the printing medium by the at least one automatic marking implement;

said array comprising a multiplicity of substantially parallel lines; and wherein the indicia are all formed in a single scan.

4. A system for determining positional deviation of at least one automatic marking implement from a nominal position; said system comprising:

a printing medium;

a positional-deviation calibration pattern comprising an array of substantially diagonal indicia formed on the printing medium by the at least one automatic marking implement; and an array of substantially vertical indicia also formed by the at least one automatic marking implement.

5. A method for establishing positional accuracy of at least one automatic marking implement relative to a nominal position; said method being for use with a printing medium having first and second mutually orthogonal directions; and said method comprising the steps of:

determining positional deviations with respect to said first direction;

operating the at least one implement along said first direction to form a test pattern on the medium;

scanning a sensor along the first direction to read the test pattern, substantially without advancing the printing medium in the second direction; and then finding positional deviations along the second direction by combining (1) said determined deviations with respect to said first direction with (2) the sensor readings of the test pattern.

6. The method of claim 5, further comprising the step of:

then applying the found positional deviations along the first and second directions to control operation of the automatic marking implement.

7. The method of claim 5, further comprising the steps of:

recording instructions for the foregoing steps in a memory device; and automatically retrieving and effectuating said instructions from the memory device to effect performance of said foregoing steps.

8. Apparatus that establishes positional accuracy of at least one automatically positioned marking device, relative to a nominal position; said marking device being for relative motion along first and second mutually orthogonal directions; and said apparatus comprising:

means for determining positional deviations with respect to said first direction;

a test pattern defined along said first direction;

a sensor mounted to such marking device;

means for scanning the sensor with the marking device together along the first direction to read the test pattern, substantially without relative motion of the sensor or device along the second direction; and means for then finding positional deviations along the second direction by combining (1) said determined deviations with respect to said first direction with (2) the sensor readings of the test pattern.

9. The apparatus of claim 8, further comprising:

means for applying the found positional deviations along the first and second directions to control operation of the automatically positioned marking device.

10. The apparatus of claim 8, further comprising:

a memory device holding recorded instructions for the foregoing steps; and means for automatically retrieving and effectuating said instructions from the memory device to effect performance of said foregoing steps.

* * * * *